US010965008B2

(12) United States Patent
Azad et al.

(10) Patent No.: US 10,965,008 B2
(45) Date of Patent: Mar. 30, 2021

(54) ELECTRONIC DEVICE WITH HOUSING SLOTS FOR ANTENNAS

(71) Applicant: Apple Inc., Cupertino, CA (US)

(72) Inventors: Umar Azad, San Jose, CA (US); Harish Rajagopalan, San Jose, CA (US); Mattia Pascolini, San Francisco, CA (US); Rodney A. Gomez Angulo, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 159 days.

(21) Appl. No.: 16/252,311

(22) Filed: Jan. 18, 2019

(65) Prior Publication Data

US 2019/0173158 A1 Jun. 6, 2019

Related U.S. Application Data

(63) Continuation of application No. 14/693,274, filed on Apr. 22, 2015, now Pat. No. 10,224,602.

(51) Int. Cl.

| | |
|---|---|
| ***H01Q 1/24*** | (2006.01) |
| ***H01Q 13/10*** | (2006.01) |
| ***H01Q 1/48*** | (2006.01) |
| ***H01Q 7/00*** | (2006.01) |
| ***H01Q 9/42*** | (2006.01) |

(52) U.S. Cl.

CPC ..... *H01Q 1/243* (2013.01); *H01Q 1/48* (2013.01); *H01Q 7/00* (2013.01); *H01Q 9/42* (2013.01); *H01Q 13/10* (2013.01)

(58) Field of Classification Search

CPC ..... H01Q 1/243; H01Q 13/10; H01Q 9/42; H01Q 7/00; H01Q 1/48

See application file for complete search history.

(56) References Cited

U.S. PATENT DOCUMENTS

| | | | | |
|---|---|---|---|---|
| 7,872,605 | B2 | 1/2011 | Baliarda et al. | |
| 8,260,199 | B2 | 9/2012 | Kowalski | |
| 8,508,418 | B2 | 8/2013 | Kough et al. | |
| 8,985,448 | B2 | 3/2015 | Jonely | |
| 10,290,946 | B2 * | 5/2019 | Romano | H01Q 13/18 |
| 2003/0122721 | A1 | 7/2003 | Sievenpiper | |

(Continued)

*Primary Examiner* — Graham P Smith
*Assistant Examiner* — Jae K Kim
(74) *Attorney, Agent, or Firm* — Treyz Law Group, P.C.; Tianyi He

(57) ABSTRACT

An electronic device housing may have a rear housing wall that forms a metal ground plane. A slot may be formed in the metal ground plane. The slot may have one or more open ends along an edge of the ground plane. A near-field communications loop antenna may overlap the slot. The near-field communications loop antenna may have one or more turns. A current path through the metal ground plane may form one of the turns in the near-field communications loop antenna. The slot may form portions of non-near-field-communications antennas in addition to the near-field communications loop antenna. The slot in the non-near-field-communications antennas may be fed using an indirect antenna feed structure. Components such as a capacitor and inductor may help allow non-near-field communications antenna and the near-field communications antenna to be formed from common portions of the metal ground plane.

20 Claims, 12 Drawing Sheets

(56) References Cited

U.S. PATENT DOCUMENTS

| | | | | |
|---|---|---|---|---|
| 2009/0153407 | A1* | 6/2009 | Zhang | H01Q 1/52 343/702 |
| 2009/0231215 | A1 | 9/2009 | Taura | |
| 2011/0241948 | A1 | 10/2011 | Bevelacqua et al. | |
| 2012/0274522 | A1* | 11/2012 | Ayatollahi | H01Q 1/243 343/745 |
| 2013/0050046 | A1 | 2/2013 | Jarvis et al. | |
| 2013/0201067 | A1 | 8/2013 | Hu et al. | |
| 2013/0203364 | A1 | 8/2013 | Darnell et al. | |
| 2013/0293424 | A1* | 11/2013 | Zhu | H01Q 1/243 343/702 |
| 2014/0266941 | A1* | 9/2014 | Vazquez | H01Q 9/42 343/746 |
| 2015/0070224 | A1* | 3/2015 | Nakano | H01Q 1/2208 343/702 |
| 2015/0077293 | A1 | 3/2015 | Korva et al. | |
| 2015/0123860 | A1 | 5/2015 | Park et al. | |
| 2015/0207223 | A1* | 7/2015 | Nakano | H01Q 1/243 343/702 |
| 2015/0207913 | A1* | 7/2015 | Nakano | H01Q 1/243 455/41.1 |
| 2016/0164178 | A1* | 6/2016 | Komachi | H01Q 1/38 343/702 |
| 2016/0268672 | A1* | 9/2016 | Liu | H01Q 1/48 |
| 2017/0012343 | A1* | 1/2017 | Wang | H04B 5/0031 |
| 2017/0033435 | A1* | 2/2017 | Nakano | H01Q 1/48 |
| 2018/0183910 | A1* | 6/2018 | Wu | H04M 1/026 |

* cited by examiner

ELECTRONIC DEVICE WITH HOUSING SLOTS FOR ANTENNAS

This application is a continuation of U.S. patent application Ser. No. 14/693,274 filed on Apr. 22, 2015, which is hereby incorporated by reference herein in its entirety. This application claims the benefit of and claims priority to U.S. patent application Ser. No. 14/693,274 filed on Apr. 22, 2015.

BACKGROUND

This relates to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry such as near-field communications circuitry. Near-field communications schemes involve electromagnetically coupled communications over short distances, typically 20 cm or less.

To satisfy consumer demand for small form factor wireless devices, manufacturers are continually striving to implement wireless communications circuitry such as antenna components using compact structures. At the same time, there is a desire for wireless devices to cover a growing number of communications bands. For example, in addition to covering local area network bands, a satellite navigation system band, and/or cellular telephone bands, it may be desirable for a wireless device to handle near-field communications.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device may be provided with a housing. A portion of the housing such as a metal rear housing wall may be used in forming a ground plane. A slot may be formed in the ground plane. The ground plane may have an edge. The slot may have one or more open ends along the edge.

A near-field communications loop antenna may overlap the slot. The slot may disrupt eddy currents in the ground plane to enhance antenna performance for the near-field communications loop antenna and may allow near-field communications signals to pass through the rear of the electronic device.

The near-field communications loop antenna may have one or more turns. A current path through the ground plane may form one of the turns in the near-field communications loop antenna. The near-field communications loop antenna may have antenna feed terminals that are coupled to the ground plane on opposing sides of the slot.

The slot and ground plane may be used in forming non-near-field-communications antennas in addition to the near-field communications loop antenna. For example, the slots may form slot antenna resonating elements. The slot elements of the non-near-field communications antennas may be fed using indirect antenna feed structures such as planar inverted-F antenna feed structures. Components such as a capacitor and inductor may help the non-near-field communications antenna and the near-field communications antenna to operate using shared portions of the ground plane.

DETAILED DESCRIPTION

Figure 1:
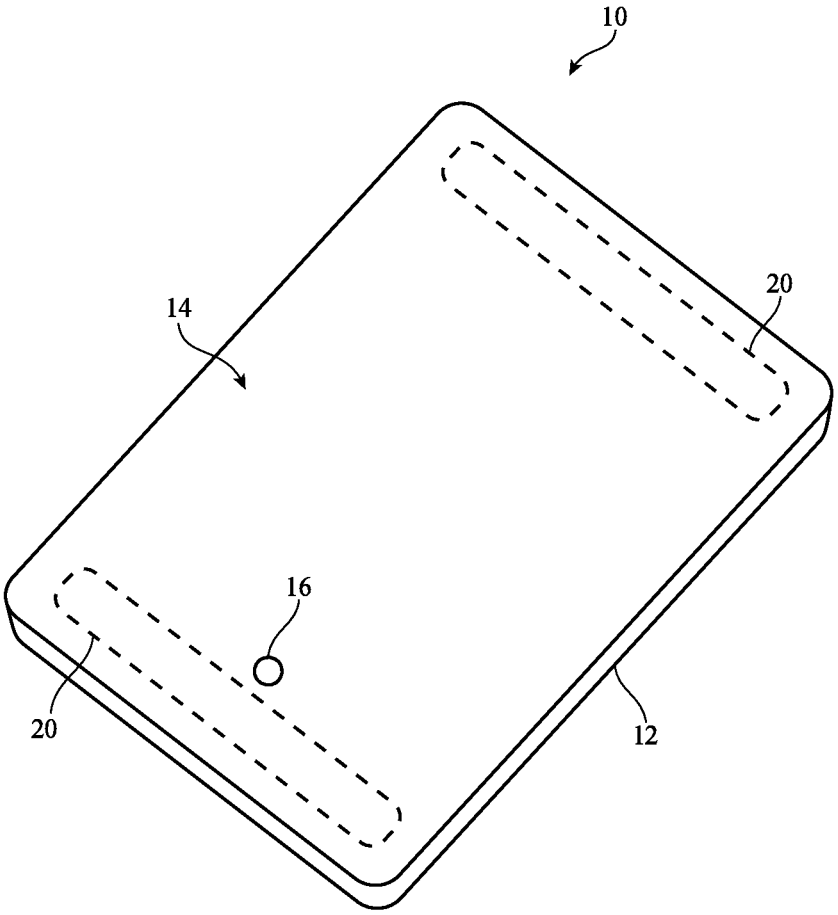
FIG. 1 is a perspective view of an illustrative electronic device in accordance with an embodiment.

An electronic device such as electronic device 10 of FIG. 1 may be provided with wireless circuitry that includes antenna structures. The antenna structures may include a near-field communications antenna. The electronic device may have ground plane structures such as conductive housing structures that are configured to facilitate near-field communications using the near-field communications antenna by blocking eddy currents and by permitting near-field communications signals to pass through the rear of the electronic device. The ground plane structures such as the conductive housing structures may also form portions of the near-field communications antenna (e.g., by forming a current path that serves as one of the turns in a near-field communications loop antenna). In some configurations, the ground plane structures may be shared with non-near-field-communications antennas. For example, the ground plane structures such as the conductive housing structures may be used in forming antennas for cellular telephone communications and/or other far-field (non-near-field) communications in addition to forming a current path for a near-field communications loop antenna.

The wireless circuitry of device 10 may handles one or more communications bands. For example, the wireless circuitry of device 10 may include a Global Position System (GPS) receiver that handles GPS satellite navigation system signals at 1575 MHz or a GLONASS receiver that handles GLONASS signals at 1609 MHz. Device 10 may also contain wireless communications circuitry that operates in communications bands such as cellular telephone bands and wireless circuitry that operates in communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications at 13.56 MHz or other near-field communications frequencies. If desired, device 10 may include wireless communications circuitry for communicating at 60 GHz, circuitry for supporting light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

In the example of FIG. 1, device 10 includes a display such as display 14. Display 14 has been mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass or clear plastic. Openings may be formed in the display cover layer. For example, an opening may be formed in the display cover layer to accommodate a button such as button 16. An opening may also be formed in the display cover layer to accommodate ports such as a speaker port. Openings may be formed in housing 12 to form communications ports (e.g., an audio jack port, a digital data port, etc.). Openings in housing 12 may also be formed for audio components such as a speaker and/or a microphone.

Antennas may be mounted in housing 12. For example, housing 12 may have four peripheral edges as shown in FIG. 1 and one or more antennas may be located along one or more of these edges. As shown in the illustrative configuration of FIG. 1, antennas may, if desired, be mounted in regions 20 along opposing peripheral edges of housing 12 (as an example). Antennas may also be mounted in other portions of device 10, if desired. The configuration of FIG. 1 is merely illustrative.

Figure 2:
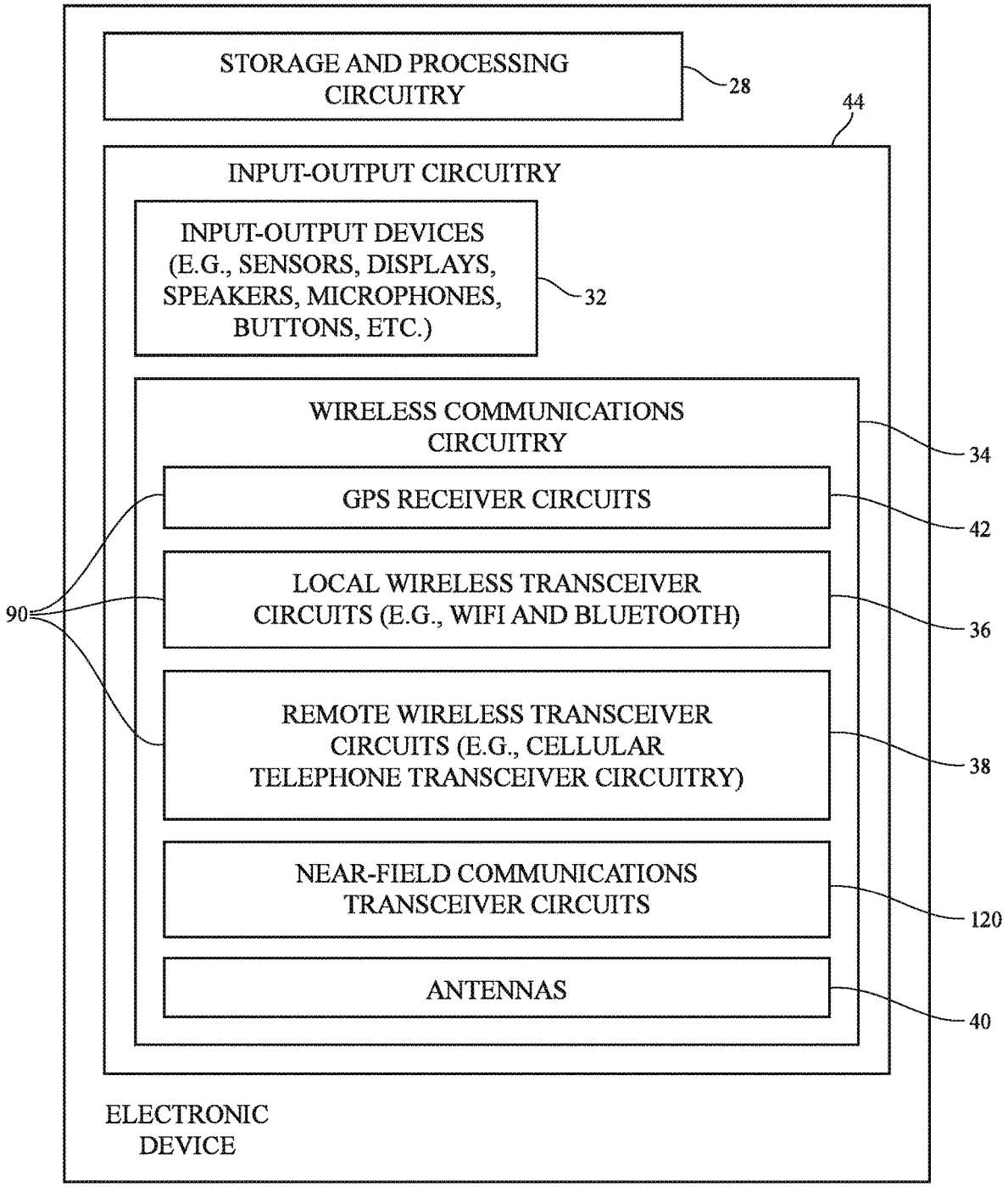
FIG. 2 is a schematic diagram of illustrative circuitry in an electronic device in accordance with an embodiment.

A schematic diagram showing illustrative components that may be used in device 10 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOW) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, near-field communications protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 may include satellite navigation system circuitry such as global positioning system (GPS) receiver circuitry 42 for receiving GPS signals at 1575 MHz or for handling other satellite positioning data. Wireless communications circuitry 34 can include circuitry for other short-range range and long-range wireless links if desired. For example, wireless communications circuitry 34 may include 60 GHz transceiver circuitry, circuitry for receiving television and radio signals, paging system transceivers, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

In addition to non-near-field communications circuitry such as circuitry 90, wireless circuitry 34 may include near-field communications circuitry 120. Near-field communications circuitry 120 may produce and receive near-field communications signals to support communications between device 10 and a near-field communications reader or other external near-field communications equipment. Near-field communications may be supported using loop antennas (e.g., to support inductive near-field communications in which a loop antenna in device 10 is electromagnetically near-field coupled to a corresponding loop antenna in a near-field communications reader). Near-field communications links are generally formed over distances of 20 cm or less (i.e., device 10 must be placed in the vicinity of the near-field communications reader for effective communications).

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna. In addition to supporting cellular telephone communications, wireless local area network communications, and other far-field wireless communications, the structures of antennas 40 may be used in supporting near-field communications for near-field communications transceiver 120. The structures of antennas 40 may also be used in gathering proximity sensor signals (e.g., capacitive proximity sensor signals), if desired.

Radio-frequency transceiver circuitry 90 does not handle near-field communications signals and is therefore sometimes referred to as far field communications circuitry or non-near-field communications circuitry. Transceiver circuitry 90 may handle non-near-field communications frequencies such as frequencies above 700 MHz or other suitable frequencies. Near-field communications transceiver circuitry 120 may be used in handling near-field communications. With one suitable arrangement, near-field communications can be supported using signals at a frequency of 13.56 MHz. Other near-field communications bands may be supported using the structures of antennas 40 if desired.

Figure 3:
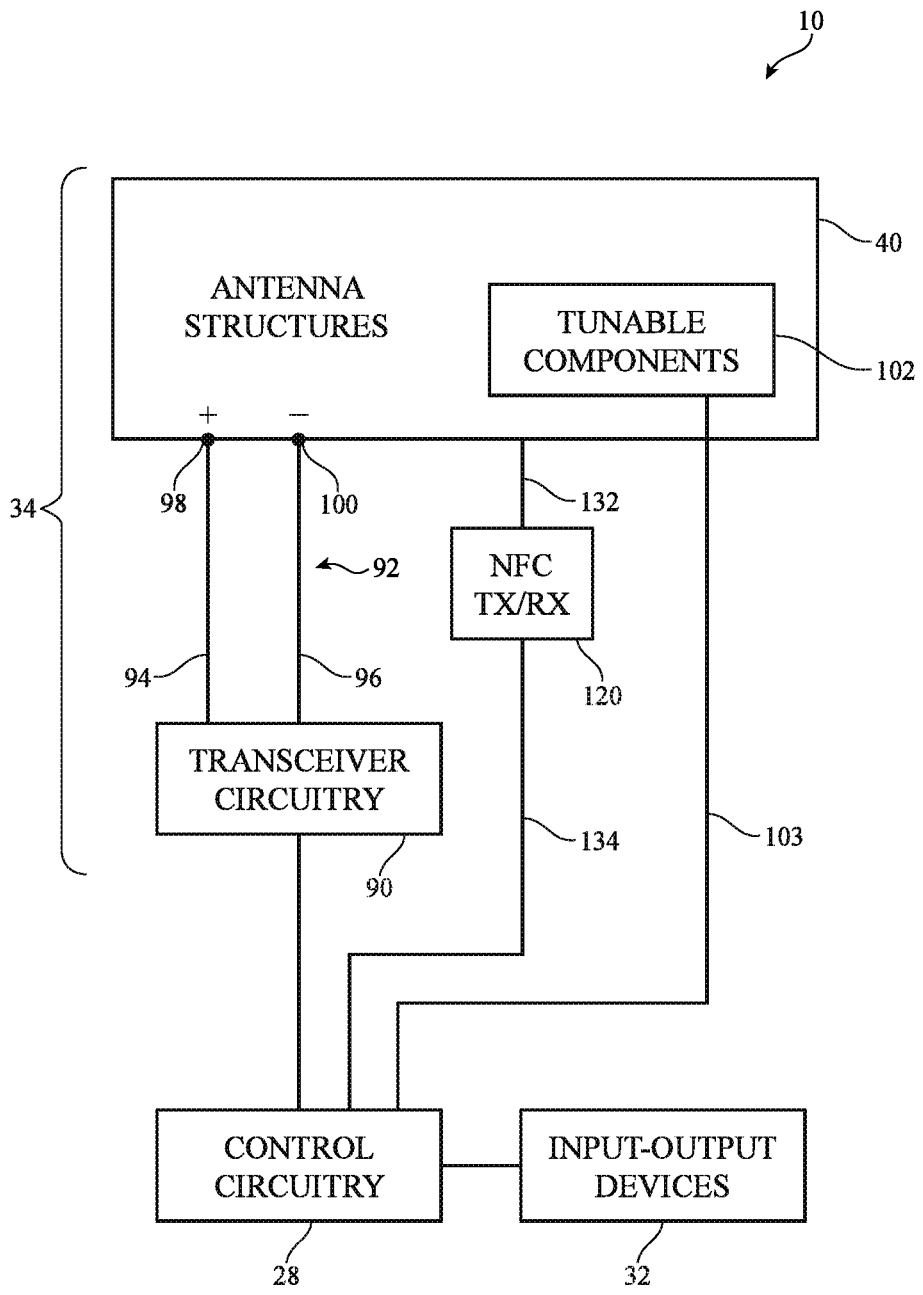
FIG. 3 is a diagram of illustrative wireless circuitry in an electronic device in accordance with an embodiment.

As shown in FIG. 3, non-near-field transceiver circuitry 90 in wireless circuitry 34 may be coupled to antenna structures 40 using paths such as path 92. Near-field communications transceiver circuitry 120 may be coupled to antenna structures 40 using paths such as path 132. Paths such as path 134 may be used to allow control circuitry 28 to transmit near-field communications data and to receive near-field communications data using transceiver 120 and a near-field communications antenna formed from structures 40.

Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with impedance matching circuitry, filters, and other antenna circuitry. This circuitry may include fixed and tunable circuits. Discrete components such as capacitors, inductors, and resistors may be incorporated into the antenna circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. For example, tunable components 102 may include one or more adjustable capacitors (e.g., a programmable capacitor that can produce one of multiple different capacitance values by adjusting switching circuitry), one or more adjustable inductors (e.g., an adjustable inductor circuit having a multiplexer or other adjustable switching circuitry that allows a desired inductor value to be selected from multiple different available inductor values), or other adjustable components.

During operation of device 10, control circuitry 28 may issue control signals on one or more paths such as path 103 that adjust inductance values, capacitance values, or other parameters associated with tunable components 102, thereby tuning antenna structures 40 to cover desired communications bands. Active and/or passive components may also be used to allow antenna structures 40 to be shared between non-near-field-communications transceiver circuitry 90 and near-field communications transceiver circuitry 120 and/or separate antenna structures may be used in forming non-near-field communications antennas and near-field communications antennas.

Path 92 may include one or more transmission lines. As an example, signal path 92 of FIG. 2 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry and other antenna circuitry in antenna structures 40.

Transmission line 92 may be directly coupled to an antenna resonating element and ground for antenna 40 or may be coupled to indirect-feed antenna feed structures that are used in indirectly feeding a resonating element for antenna 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Antenna structures 40 may include an antenna resonating element such as a slot antenna resonating element or other element that is indirectly fed. In indirect feeding arrangements, transmission line 92 is coupled to an antenna feed structure that is used to indirectly feed antenna structures such as an antenna slot or other element through electromagnetic near-field coupling.

Antennas 40 may include slot antenna structures, inverted-F antenna structures (e.g., planar and non-planar inverted-F antenna structures), loop antenna structures, or other antenna structures.

Figure 4:
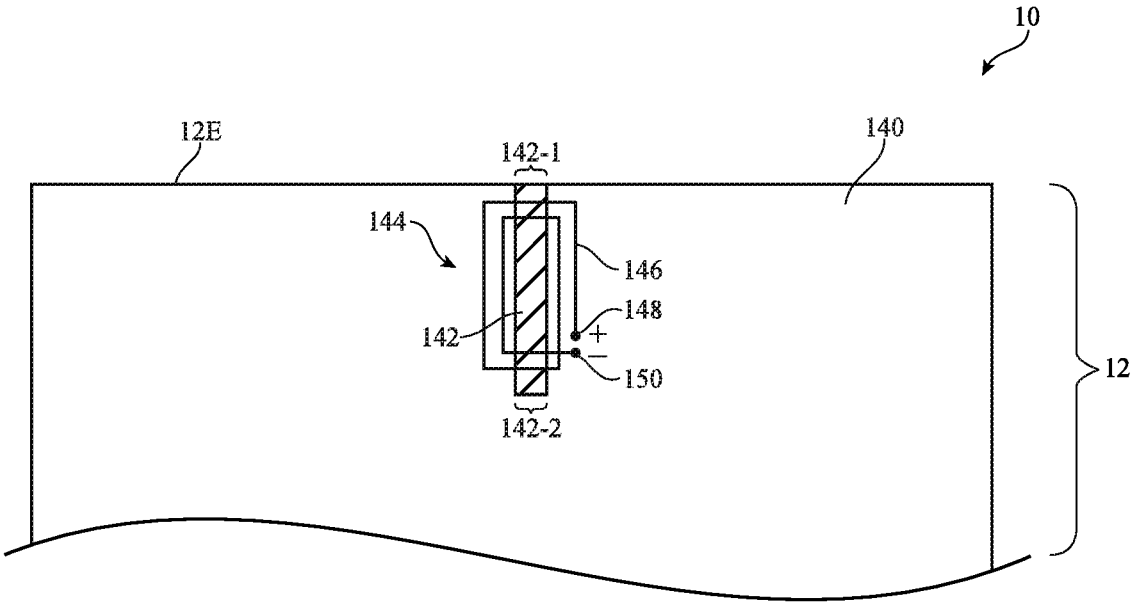
FIG. 4 is an interior view of an illustrative electronic device with a housing slot and a near-field communications antenna that overlaps the slot in accordance with an embodiment.

Device 10 may include a ground plane that serves as antenna ground in a slot antenna, an inverted-F antenna, or other suitable antenna(s). The ground plane may be formed from metal traces on a printed circuit or other substrate, conductive components in device 10 (e.g., components containing metal), and/or conductive housing structures (e.g., housing 12 or parts of housing 12 may be formed from metal and may be used in forming an antenna ground). An illustrative ground plane (sometimes referred to as ground or antenna ground) is shown in FIG. 4. As shown in FIG. 4, ground plane 140 may have a rectangular shape (e.g., a rectangular shape with four edges that run parallel to each of the four edges of device 10 of FIG. 1).

Ground plane 140 may be formed from a metal housing (e.g. the rear wall and sidewalls of housing 12 of FIG. 1), may be formed from metal traces on one or more printed circuits, may be formed from conductive electronic components (e.g., metal shield cans, etc.), and/or may be formed from other conductive structures in device 10. If desired, multiple ground structures may overlap one another within device 10. Configurations in which ground 140 includes the rear metal housing wall of housing 12 are sometimes described herein as an example. Device 10 may have conductive housing sidewalls that extend upwards from the rear metal housing wall (e.g., as curved or straight extensions of the rear housing wall), may have a display bezel or peripheral housing band that is formed from a separate metal member that is shorted to the rear housing wall or may, in some scenarios, be formed form a non-conductive material such as plastic.

In scenarios in which the sidewalls or portions of the sidewalls of housing 12 are formed from dielectric, the ground plane for device 10 can be formed from the metal rear housing wall (and/or internal conductive structures). In scenarios in which the sidewalls or portions of the sidewalls are formed from a conductive material such as metal, these sidewall structures may form part of the ground plane for device 10. Ground plane 140 may have a flat shape (i.e., a planar shape associated with the rear face of device 10 which may or may not include short vertically extending sidewall portions), may have a curved shape (e.g., when device 10 has a convex or concave rear face), or may have other suitable shapes.

In configurations in which ground 140 is formed from a portion of a conductive housing such as metal housing 12, it may be desirable to form one or more openings in the metal of the housing. The openings may have elongated shapes and may therefore sometimes be referred to as slots. The slots may be straight slots (i.e., slots without bends when viewing housing 12 from above), may be L-shaped slots (slots with one bend), may be U-shaped slots (slots with two bends), or may have other suitable shapes.

Plastic, glass, ceramic, or other dielectric materials may fill the openings in the metal housing. As shown in FIG. 4, for example, ground plane 140 may have a slot such as slot 142 that runs inwardly toward the center of housing 12 from upper housing edge 12E. This slot (and the other illustrative slots in ground 14) may be filled with plastic or other dielectric.

In configurations for device 10 in which housing 12 has metal sidewalls that extend upwardly from the rear face of housing 12, slots such as slot 142 of FIG. 4 may extend through the metal sidewalls (i.e., edge 12E may be associated with the upper surface of the metal sidewalls where the metal sidewalls meet the display cover layer of display 14 or other display structures). In configurations for device 10 in which housing 12 has dielectric sidewalls and a metal rear housing wall, edge 12E may be associated with the periphery of the metal rear wall.

In the example of FIG. 4, slot 142 has a straight outline (when viewed from above as in FIG. 4) with opposing ends 142-1 and 142-2. Slot end 142-1 may be open to the air surrounding device 10 and/or a dielectric display cover layer and may therefore be referred to as an open end of slot 142. Slot end 142-1 may be surrounded by portions of ground 140 and may therefore be referred to as a closed end of slot 142. Slots of the type shown in FIG. 4 that have opposing open and closed ends are sometimes referred to as open slots. If desired, housing 12 may contain closed slots (i.e., slots with two opposing closed ends).

Near-field communications antenna 144 may be formed in device 10 in a location that overlaps slot 142 (i.e., a location where the footprint of antenna 144 covers some or all of slot 142). Antenna 144 may be a loop antenna. and may contain one or more loops of conductor (e.g., one or more loops of wire, one or more loops of metal traces on a printed circuit, or other suitable conductive loops). In the example of FIG. 4, antenna 144 has two loop-shaped conductive paths 146 (i.e., antenna 144 has two turns formed from conductive paths 146). In general, antenna 144 may be a loop antenna with 5-50 turns, 20-25 turns, more than 20 turns, fewer than 25 turns, more than 2 turns, fewer than 30 turns, or any other suitable number of turns. The outline of the loop of antenna 144 (i.e., the footprint of antenna 144 when viewed from above as shown in FIG. 4) preferably overlaps at least some of slot 142. In the example of FIG. 4, slot 142 is sufficiently long to bisect antenna 144.

The presence of slot 142 helps antenna 144 operate satisfactorily within conductive housing 12. In particular, the presence of slot 142 may disrupt eddy currents that might otherwise develop within housing 12 under antenna 144. This disruption of eddy currents helps improve antenna efficiency when antenna 144 is operated in the upwards direction (i.e., out of the page of FIG. 4 and through a portion of the front face of device 10 such as through inactive edge portions of display 14). When operated in the opposite direction (i.e., into the page of FIG. 4 and out of the rear face of device 10), the dielectric opening formed by slot 142 may allow near-field communications electromagnetic signals to exit device 10 through the rear housing wall. These signals might otherwise be blocked by the metal of the rear housing wall if antenna 144 were completely covered with the metal of the rear housing wall. The size of slot 142 may be larger to enhance near-field communications antenna efficiency or the size of slot 142 may be smaller to enhance device aesthetics. With one suitable arrangement, the width of slot 142 may be less than 5 mm, less than 3 mm, less than 2 mm, less than 1 mm, greater than 0.1 mm, 0.1-2 mm, 0.1-0.7 mm, or other suitable size.

Antenna 144 has an antenna feed formed from positive antenna feed terminal 148 and ground antenna feed terminal 150. The antenna feed for antenna 144 may be coupled to near-field communications transceiver 120 (FIG. 3) by signal lines in path 132 to allow antenna 144 to transmit and receive near-field communications signals.

Figure 5:
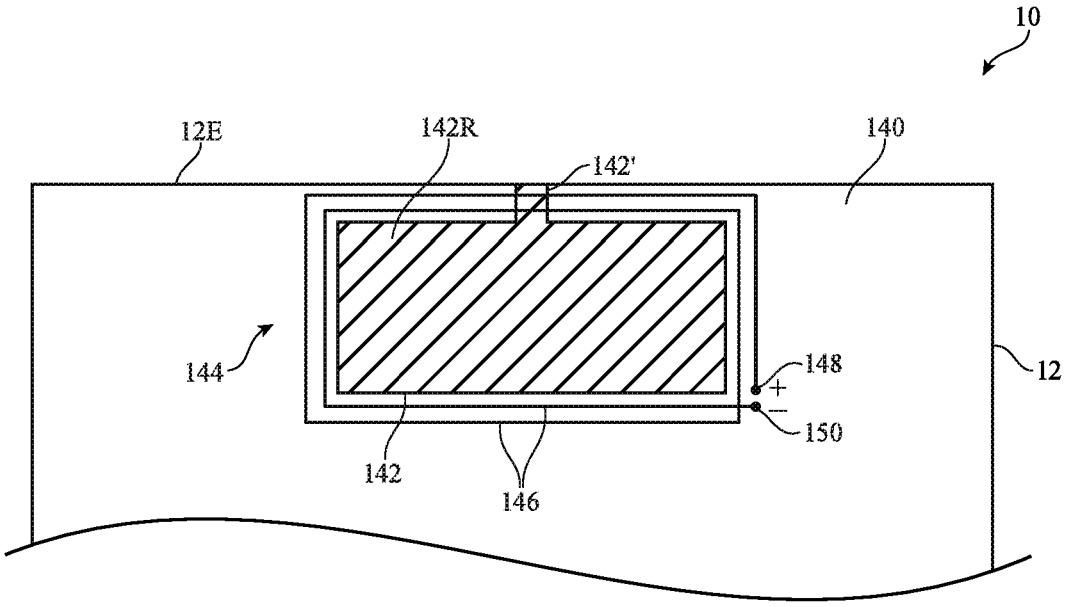
FIG. 5 is an interior view of an illustrative electronic device with a rectangular dielectric window overlapped by a near-field communications antenna in accordance with an embodiment.

In the illustrative configuration of FIG. 5, dielectric opening 142 has a shape that matches the outline of near-field communications antenna 144 (i.e., the size of opening 142 matches the size of antenna 144). In particular, opening 142 may have a main rectangular window portion such as portion 142R to allow near-field communications signals to pass through the rear wall of device 10. Opening 142 may also have a segment such as segment 142' that extends from opening 142R to upper housing edge 12E to help block eddy currents that might be induced in housing 12 during operation of antenna 144.

Figure 6:
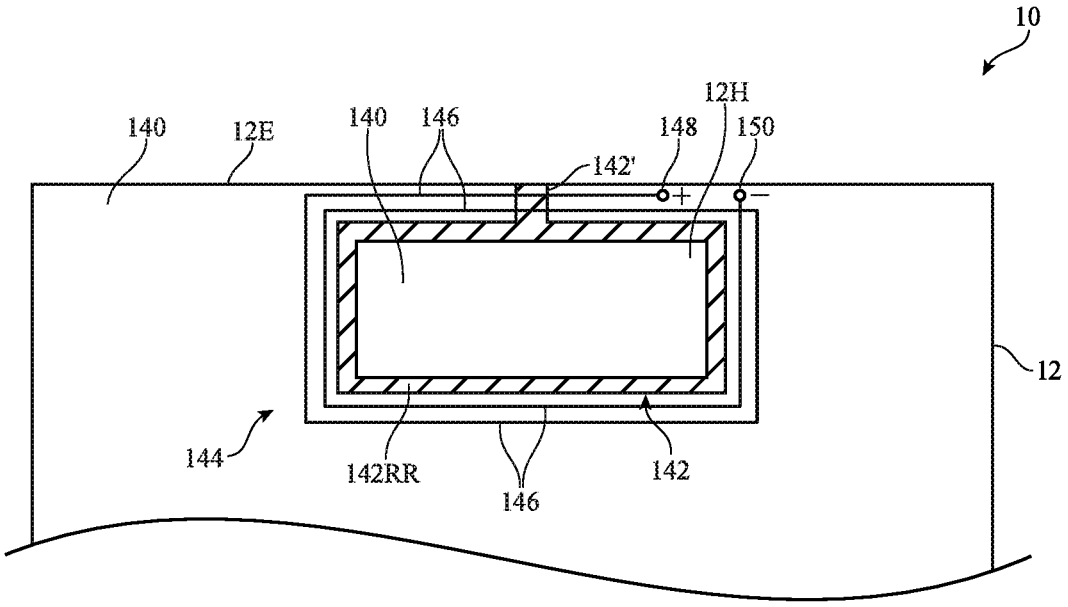
FIG. 6 is an interior view of an illustrative electronic device having a slot with a rectangular ring and a straight segment that is joined to the ring and having a near-field communications structure that overlaps the slot in accordance with an embodiment.

Dielectric-filled opening 142 of FIG. 5 may consume more area than desired. An arrangement for opening 142 that consumes a relatively small amount of area and which is therefore less visible when viewing the rear of device 10 is shown in FIG. 6. In the example of FIG. 6, dielectric opening 142 in housing 12 has a ring portion (rectangular ring 142RR) that is joined to segment 142'. Central portion 12H of metal housing 12, which forms an inner portion of ground plane 140, may be surrounded by rectangular ring 142RR. As with the configuration of FIG. 4, the configuration of FIG. 6 may help block eddy currents (and thereby enhance operation of antenna 144 out of the front of device 10 and may create a dielectric gap that allows antenna 144 to operate out of the rear of device 10. Openings 142 such as illustrative ring 142RR of FIG. 5 may have curved segments, straight segments, combinations of curved and straight segments, or other suitable shapes. The configuration of FIG. 6 in which ring 142RR has a rectangular outline surrounding a rectangular metal portion 12H of housing 12 is merely illustrative.

Figure 7:
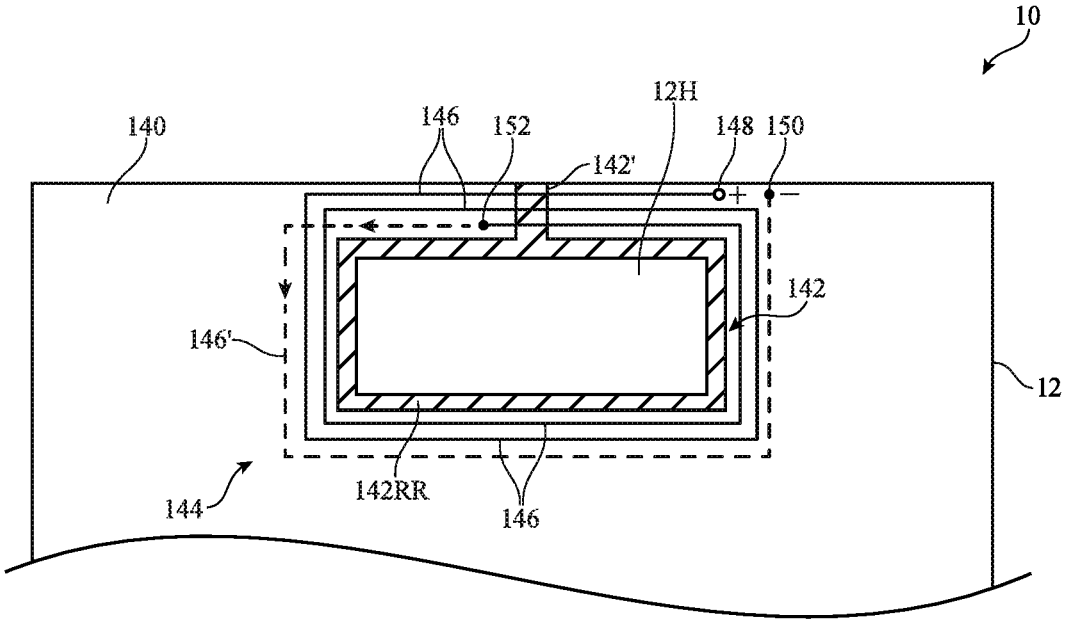
FIG. 7 is an interior view of an illustrative electronic device having a slot with a rectangular ring and a straight segment that is joined to the ring and having a near-field communications structure that overlaps the slot and is partly formed using portions of a conductive housing in accordance with an embodiment.

If desired, a portion or all of loop antenna 144 may be formed using current paths that pass through conductive housing structures such as portions of a rear wall (and, if desired, sidewall portions) in metal housing 12. This type of configuration is shown in FIG. 7. As shown in FIG. 7, opening 142 in housing 12 may have a slot that forms rectangular ring 142RR and slot segment 142', as described in connection with FIG. 6. Some of the turns of loop antenna 144 may be formed by conductive paths 146 (e.g., metal traces on a printed circuit, turns of wire, etc.). In the example of FIG. 7, an additional turn of loop antenna 144 has been formed by conductive path 146' through metal housing 12. Path 146' starts at node 152, where the conductor of one of paths 146 is shorted to metal housing 12 and continues around the periphery of opening 142RR to ground terminal 150 on metal housing 12.

Figure 8:
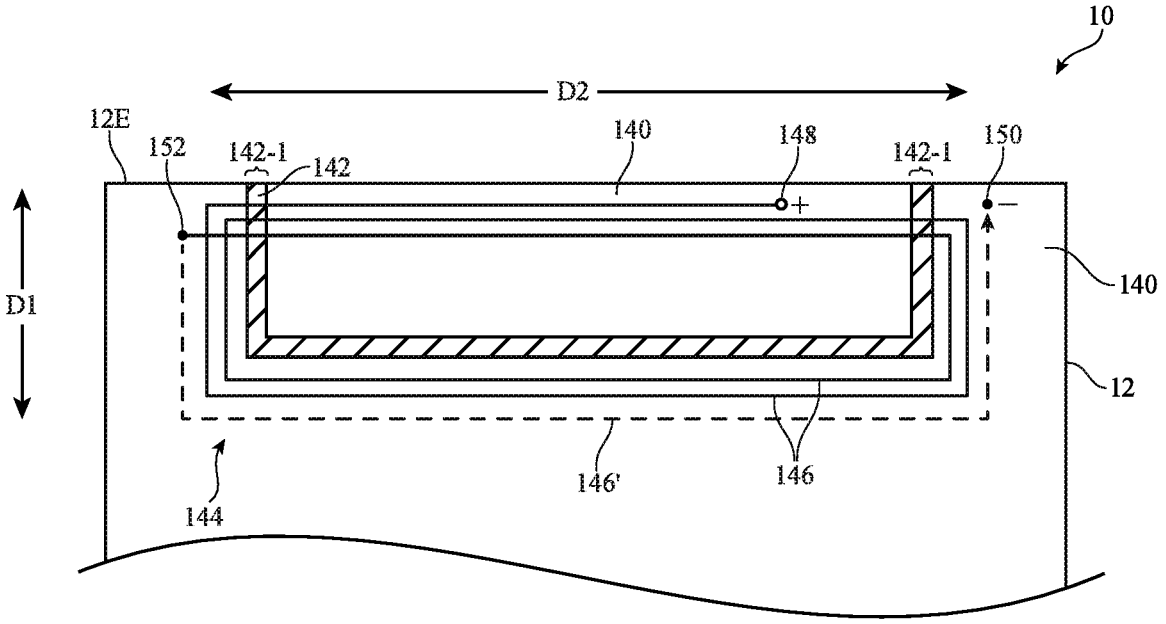
FIG. 8 is an interior view of an illustrative electronic device having a U-shaped slot that is overlapped by a near-field communications antenna in accordance with an embodiment.

In the illustrative configuration of FIG. 8, the turns of loop antenna 144 include conductive paths 146 (e.g., wires, traces on a printed circuit, etc.) and conductive housing path 146'. Antenna 144 overlaps slot 142. Slot 142 has a U-shape with a pair of opposing open ends 142-1 in edge 12E of housing 12. The presence of slot 142 may help disrupt eddy currents that might otherwise adversely affect antenna performance and may allow near-field communications antenna signals to be transmitted and received through the rear of housing 12. The width of slot 142 may be about 0.1-0.9 mm, may be less than 1.5 mm, may be more than 0.1 mm, or may have other suitable sizes. Lateral dimension D2 of antenna 144 may be about 15-28 mm, more than 10 mm, less than 35 mm, or other suitable sizes. Perpendicular lateral dimension D1 of antenna 144 may be about 8-14 mm, more than 5 mm, less than 25 mm, or other suitable size.

Near-field communications loop antenna 144 may, if desired, be formed using housing structures that form a common ground (ground 140) with non-near-field communications antennas (e.g., wireless local area network antennas, satellite navigation system antennas, cellular telephone antennas, other antennas that operate at frequencies of 700 MHz to 5 GHz, etc.). Non-near-field antennas in device 10 may be fed using a direct feeding arrangement or an indirect feeding arrangement. As an example, device 10 may contain an antenna that includes a slot antenna resonating element. The slot antenna resonating element may be formed from some or all of slot 142 in ground 140 (e.g., portions of metal housing 12 such as a rear housing wall). The slot antenna resonating element may form a slot antenna or may form a slot portion of a hybrid antenna such as a planar-inverted-F-slot antenna or an inverted-F-slot antenna.

With a direct feeding arrangement, the slot antenna resonating element formed from slot 142 may be fed using terminals that are coupled to ground 140 on opposing sides of the slot. With an indirect feeding arrangement, an antenna feed structure such as illustrative planar-inverted-F element 154 of FIG. 9 may serve as an indirect antenna feed structure for the antenna. Element 154 may be near-field coupled to the slot antenna resonating element formed from slot 142.

Figure 9:
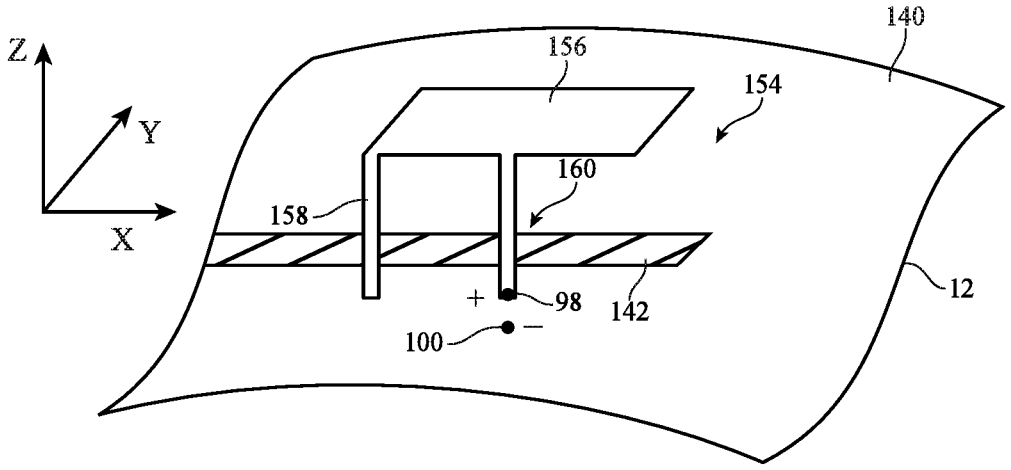
FIG. 9 is a perspective view of an illustrative planar-inverted-F antenna resonating element that may be used to indirectly feed a slot antenna in accordance with an embodiment.

Element 154 may have a planar resonating element portion such as planar member 156 that overlaps slot 142. Return path 158 may be shorted between member 156 and ground 140. Feed 160 may be coupled between member 156 and ground 140 in parallel with return path 158. Feed 160 may include positive antenna feed terminal 98 and ground antenna feed terminal 100. If desired, other arrangements may be used to feed the slot antenna resonating element formed from slot 142. Planar-inverted-F feed structure 154 of FIG. 9 is merely illustrative.

Figure 10:
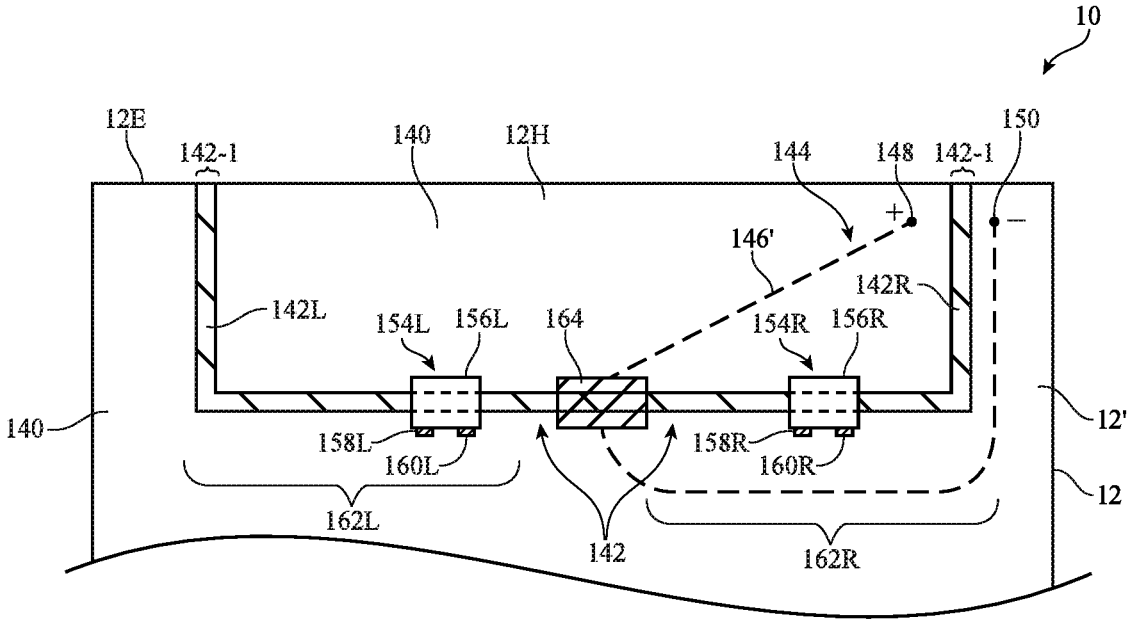
FIG. 10 is an interior view of an illustrative electronic device having a pair of antennas formed from slots in a conductive housing and having a near-field communications antenna that is formed using the conductive housing in accordance with an embodiment.

An interior view of a portion of electronic device 10 in an illustrative configuration in which there are two independently fed antennas formed from left and right branches of slot 142 are is shown in FIG. 10. As shown in FIG. 10, slot 142 in ground 140 (i.e., metal housing 12) has left segment 142L and right segment 142R, each with an open end 142-1 along edge 12E. Conductive structure 164 (e.g., metal traces in a printed circuit, metal foil, a metal member formed from a sheet of metal, a portion of housing 12, or other conductive structures) may bridge the middle of slot 142 and thereby short housing 12 on opposing sides of slot 142. The presence of conductive structure 164 bisects slot 142 into left and right portions 142L and 142R and may form closed slot ends for the resulting left and right slots formed form slot 142.

Left slot 142L may form a slot antenna resonating element for non-near-field communications antenna 162L. Antenna 162L may be indirectly fed using indirect antenna feed structure 154L (i.e., a structure with planar portion 156L, return path 158L, and feed 160L, as described in connection with FIG. 9). Right slot 142R may form a slot antenna resonating element for non-near-field communications antenna 162R. Antenna 162R may be indirectly fed using indirect antenna feed structure 154R (i.e., a structure with planar portion 156R, return path 158R, and feed 160R, as described in connection with FIG. 9). Antennas 162L and 162R may be wireless local area network antennas, satellite navigation system antennas, cellular telephone antennas, or other antennas for supporting non-near-field communications.

Near-field communications loop antenna 144 has feed terminals 148 and 150. Terminal 148 is shorted to housing portion 12H of ground 140. Terminal 150 is shorted to housing portion 12' of housing 12. Near-field communications loop antenna 144 is formed from a loop-shaped conductive path (path 146') that forms a turn in loop antenna 144 that passes from terminal 148 to terminal 150 through the metal of housing portion 12H, the metal of conductive structure 164, and the metal of housing 12', as shown in FIG. 10. With this type of arrangement, antenna 144 is formed at least partly from the same ground plane 140 that is used in forming a non-near-field antenna in device 10.

Figure 11:
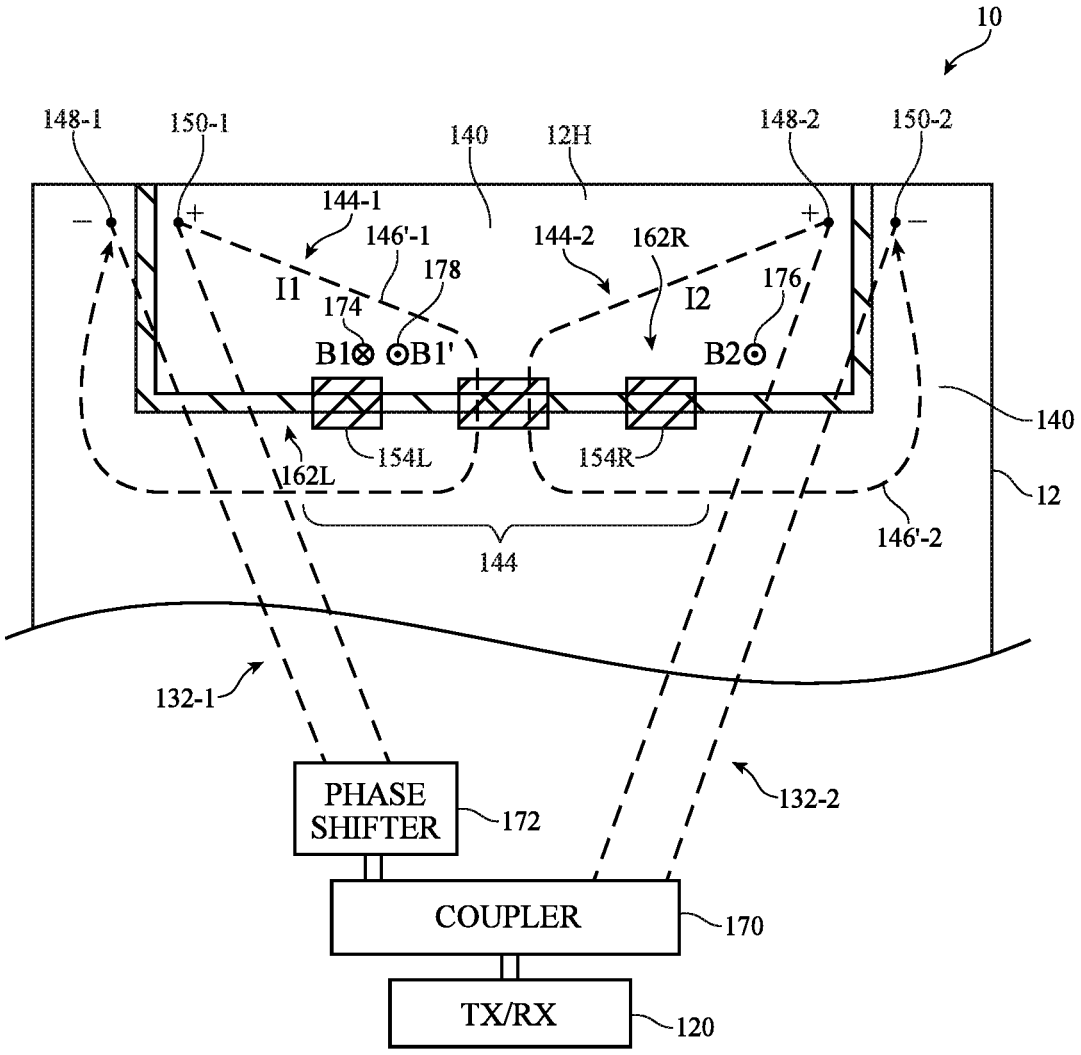
FIG. 11 is an interior view of an illustrative electronic device in which a near-field communications antenna has been formed from two portions of a conductive housing that are driven out-of-phase in accordance with an embodiment.

In the arrangement of FIG. 11, current loops 146' are formed in portions of ground plane 140 associated with both left antenna 162L and right antenna 162R. Current loop 146'-1, passes through the portion of ground plane 140 associated with antenna 162L and carries current I1. Current loop 146'-2 passes through the portion of ground plane 140 associated with antenna 162R and carries current I2. Current loop path 146'-1 and current loop path 146'-2 form first and second respective portions 144-1 and 144-2 of near-field communications antenna 144. Near-field communications transceiver 120 may be coupled to terminals 148-1 and 150-1 at the feed of antenna portion 144-1 through coupler 170, phase shifter 172 (e.g., a 180° phase shifter), and path 132-1. Near-field communications transceiver 120 may be coupled to terminals 148-2 and 150-2 at the feed of antenna portion 144-2 through coupler 170 and path 132-2. In the absence of phase shifter 172, current I1 will induce a magnetic field B1 that is oriented into the page of FIG. 11 (as indicated by field 174) at the same time that current I2 induces a magnetic field B2 that is oriented out of the page (as indicate by field 176). By virtue of phase shifter 172, the out-of-phase version of magnetic field B1 is converted to in-phase magnetic field B1'. As indicated by the parallel direction of field 178 of B1' and field 176 of B2, the use of phase shifter 172 ensures that the near-field signals produced by near-field communications antenna portions 144-1 and 144-2 will add constructively, thereby allowing portions 144-1 and 144-2 to form near-field communications loop antenna 144.

Figure 12:
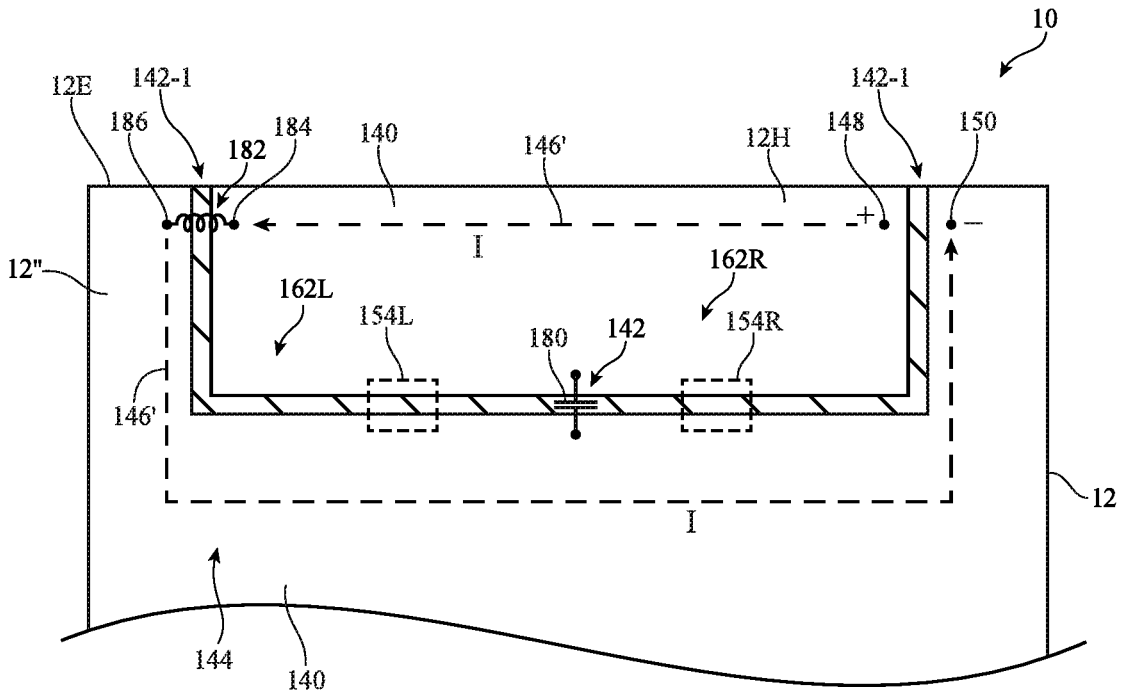
FIG. 12 is an interior view of an illustrative electronic device having a slot bridged by a capacitor that forms a short circuit during high frequency antenna operation associated with non-near-field-communications antenna operation and that forms an open circuit at frequencies associated with use of a near-field communications antenna in accordance with an embodiment.

If desired, a component such as capacitor 180 of FIG. 12 may be used to bridge slot 142 in the middle of slot 142. Inductor 182 may have a first terminal (terminal 184) coupled to housing portion 12H on one side of slot 142 and a second terminal (terminal 186) coupled to housing portion 12" on the other side of slot 142. At near-field communications frequencies (e.g., 13.56 MHz), inductor 182 is a short circuit. As a result, current loop 146' for near-field communications loop antenna 144 may be established between antenna feed terminal 148 on housing portion 12H and antenna feed terminal 150. The path of current loop 146' may be formed using a segment of housing 12H, inductor 182, and the portion of housing 12 that runs along the lower edge of slot 142 and back to antenna feed terminal 150. At near-field communications frequencies, capacitor 180 is an open circuit, so current 146' will not be diverted across the middle of slot 142 and will flow in a loop that surrounds slot 142. At non-near-field communications frequencies (e.g., frequencies above 13.56 MHz such as frequencies at 700 MHz and above), capacitor 180 is a short circuit and inductor 182 is an open circuit. The short circuit of capacitor 180 divides slot 142 into left and right portions for non-near-field-communications antennas 162L and 162R. The open circuit of inductor 182 ensures that slot 142 will have two open ends 142-1 along edge 12E. The middle of slot 142 will be a short circuit (and therefore will form closed ends for the left and right portions of the slot) at non-near-field-communications frequencies.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having first and second conductive portions;

a slot element that separates the first and second conductive portions of the housing;

a conductive structure coupled across the slot element; and a near-field communications antenna having first and second antenna feed terminals coupled to the housing, wherein the near-field communications antenna is formed from a conductive path through the housing and the conductive structure.

2. The electronic device defined in claim 1, wherein the first antenna feed terminal is coupled to the first conductive portion of the housing on a first side of the slot element and the second antenna feed terminal is coupled to the second conductive portion of the housing on a second side of the slot element that opposes the first side of the slot element.

3. The electronic device defined in claim 2, wherein the conductive path is formed through the first and second conductive portions of the housing.

4. The electronic device defined in claim 3, further comprising:

a first slot antenna resonating element formed from a first portion of the slot element; and a second slot antenna resonating element formed from a second portion of the slot element.

5. The electronic device defined in claim 4, further comprising:

near-field communications transceiver circuitry coupled to the first and second antenna feed terminals; and non-near-field communications transceiver circuitry coupled to the first and second slot antenna resonating elements.

6. The electronic device defined in claim 1, wherein the slot element has an open end at an edge of the housing.

7. The electronic device defined in claim 6, wherein the slot element extends from the open end into the housing and towards the conductive structure.

8. The electronic device defined in claim 7, wherein the slot element has a first slot portion that extends along a first direction and has a second slot portion that extends along a second direction that is perpendicular to the first direction.

9. The electronic device defined in claim 1, wherein the housing comprises a rear housing wall and a housing sidewall, and the slot element extends through the rear housing wall and the housing sidewall to separate the first and second conductive portions of the housing.

10. The electronic device defined in claim 1, wherein the conductive structure is an inductor having a first terminal coupled to the first conductive portion of the housing on a first side of the slot element and having a second terminal coupled to the second conductive portion of the housing on a second side of the slot element.

11. An electronic device, comprising:

conductive housing structures;

a slot in the conductive housing structures;

a near-field communications antenna formed from a conductive path that overlaps the slot and having an antenna feed coupled to the conductive housing structures;

near-field communications transceiver circuitry coupled to the antenna feed and configured to convey near-field communications signals using the near-field communications antenna;

a slot antenna resonating element formed from the slot; and non-near-field communications transceiver circuitry configured to convey non-near-field communications signals using the slot antenna resonating element.

12. The electronic device defined in claim 11, further comprising:

an electrical component overlapping the slot to separate the slot into first and second slot portions.

13. The electronic device defined in claim 12, wherein the slot antenna resonating element is formed from the first slot portion.

14. The electronic device defined in claim 13, further comprising:

an additional slot antenna resonating element formed from the second slot portion, wherein the non-near-field communications transceiver circuitry is configured to convey the non-near-field communications signals using the additional slot antenna resonating element.

15. The electronic device defined in claim 12, further comprising:

a conductive structure overlapping the slot, wherein the conductive path is formed through the conductive housing structures and the conductive structure.

16. The electronic device defined in claim 15, wherein the conductive housing structures comprise an electronic device sidewall and the electronic device sidewall is separated into first and second portions by the slot.

17. The electronic device defined in claim 16, wherein the conductive housing structures comprise an electronic device rear wall that is separated into first and second portions by the slot and the conductive path is formed through the first and second portions of the electronic device rear wall.

18. An electronic device, comprising:

conductive housing structures that include a conductive rear housing wall having an edge;

a slot in the conductive rear housing wall, wherein the slot has an open end along the edge, a first portion of the slot extends from the open end into the rear housing wall, and a second portion of the slot extends from the first portion of the slot to a conductive structure that bridges the slot; and a near-field communications loop antenna having first and second antenna feed terminals coupled to the conductive housing structures and having a conductive loop path that overlaps the slot.

19. The electronic device defined in claim 18, wherein the first and second antenna feed terminals are respectively coupled on opposing sides of the first slot portion and the conductive path is formed around the first and second slot portions and across the slot.

20. The electronic device defined in claim 19, wherein the first portion of the slot extends along a first direction and the second portion of the slot extends along a second direction that is perpendicular to the first direction.

* * * * *